United States Patent [19]

Rarey

[11] 4,010,049

[45] Mar. 1, 1977

[54] COLUMBIUM-STABILIZED HIGH CHROMIUM FERRITIC STAINLESS STEELS CONTAINING ZIRCONIUM

[75] Inventor: Charles R. Rarey, Eighty-Four, Pa.

[73] Assignee: Jones & Laughlin Steel Corporation, Pittsburgh, Pa.

[22] Filed: Oct. 6, 1975

[21] Appl. No.: 619,732

[52] U.S. Cl. ..... 148/37; 75/126 C; 75/126 F

[51] Int. Cl.[2] ..... C22C 38/22; C22C 38/28

[58] Field of Search ..... 75/126 D, 126 C, 126 F, 75/126 R; 148/37

[56] References Cited

UNITED STATES PATENTS

| | | | |
|---|---|---|---|
| 2,793,113 | 5/1957 | Rait et al. | 75/128 G |
| 3,852,063 | 12/1974 | Niimi et al. | 75/126 D |
| 3,890,143 | 6/1975 | Skoglund | 75/126 D |
| 3,926,624 | 12/1975 | Aronson et al. | 75/126 F |

FOREIGN PATENTS OR APPLICATIONS

| | | | |
|---|---|---|---|
| 884,806 | 11/1971 | Canada | 75/126 F |
| 2,124,391 | 12/1971 | Germany | 75/126 F |

*Primary Examiner*—Arthur J. Steiner
*Attorney, Agent, or Firm*—Gerald K. White; T. A. Zalenski

[57] ABSTRACT

The inclusion of small interrelated amounts of zirconium and columbium to ferritic stainless steels results in a stabilized steel having good pitting corrosion resistance and good ductility.

3 Claims, 3 Drawing Figures

Figure 1:
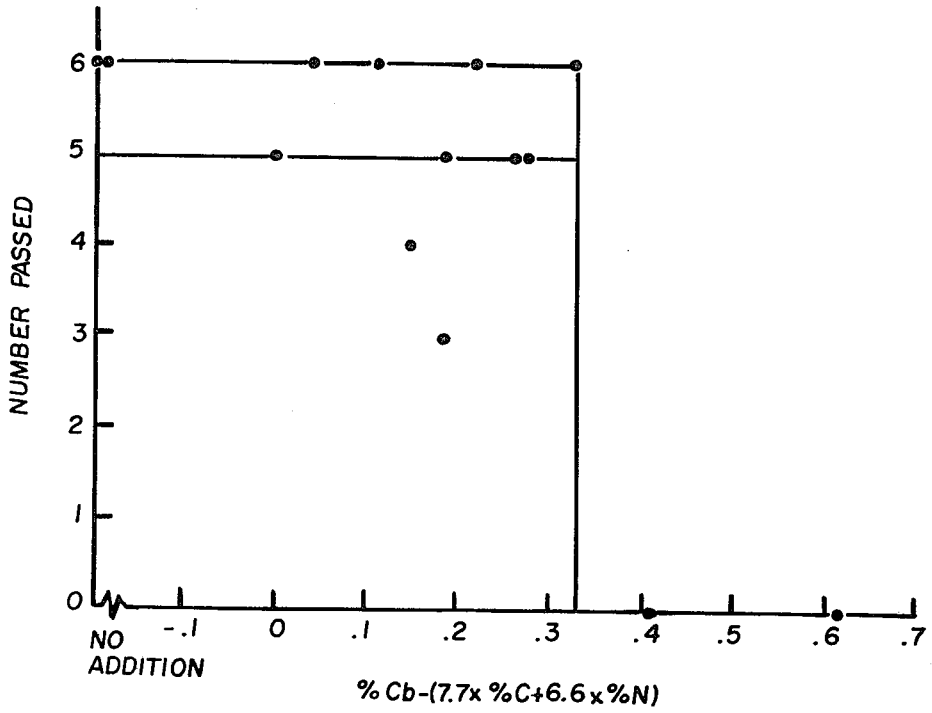

COLUMBIUM-STABILIZED HIGH CHROMIUM FERRITIC STAINLESS STEELS CONTAINING ZIRCONIUM

The invention generally relates to a ferritic stainless alloy and product in which columbium and zirconium are added in controlled, interrelated amounts to produce a stabilized steel having good resistance to pitting corrosion and good ductility as measured by weld bend testing. To ensure that effective stabilization and good ductility are obtained, the formation of grain boundary carbides and nitrogen in solution must be avoided. In addition, the formation of chromium carbides and nitrides lead to inferior corrosion resistance when the steel has been subjected to certain thermal cycles, particularly welding. The invention utilizes a combination of columbium and zirconium to beneficially tie-up carbon and nitrogen and thus produce a steel having a desirable combination of properties.

Columbium-stabilized ferritic stainless steels such as AISI Type 436 are believed to lack good ductility primarily because nitrogen is not effectively removed from solution. Because zirconium is much more effective in removing nitrogen from solution than columbium, zirconium additions to columbium-bearing ferritic stainless steels lead to substantial ductility improvement. However, it has also been discovered that zirconium contents significantly in excess of that required to combine with nitrogen lead to surface streaking and the formation of brittle intermetallic compounds. Thus, it may be seen that the stainless steel of the invention is carefully designed to utilize zirconium in combination with columbium in amounts embracing a relatively narrow range in which the ductility of the steel is enhanced.

Although the prior art contains patents which include both columbium and zirconium in ferritic stainless steels, for example, U.S. Pat. Nos. 2,985,529 and 3,139,358, it is believed that there is no apparent recognition that columbium and zirconium can be controlled within specific limits to achieve a highly desirable and advantageous combination of stabilization and ductility.

It is thus an object of the invention to provide a stainless steel composition that is stabilized and has good ductility.

It is a further objective to obtain a wrought ferritic stainless steel product characterized by minimal surface streaking.

The stainless steels of the invention are of the fully ferritic type. Such steels are well known in the art and therefore one skilled in the art is readily able to select an overall compositional balance between ferrite and austenite promoting elements to achieve a fully ferritic state at all temperatures. Consequently, no further description of this class of stainless steels is necessary and it will be understood by those skilled in the art that various austenite formers may be included in the steel of the invention in amounts that do not cause the steel to lose its ferritic nature.

The ferritic stainless steel of the invention consists of the following composition:

| | | |
|---|---|---|
| Carbon | - | 0.10% maximum; 0.06% preferred |
| Chromium | - | about 11% to about 30% |
| Molybdenum | - | up to 3.0% |
| Columbium | - | about 0.1% total to 0.3% in solid solution, however, in no event less than (7.7 × %C - % Zr in excess of 6.5 × %N) |
| Zirconium | - | 6.5 × N% to 0.25% in excess of (6.5 × %N × 7.6 × %C) |
| Nitrogen | - | residual quantities, typically .01% to .06% for most stainless steel refining processes |
| Iron | - | balance, except for residual impurities. |

Carbon should be maintained at about 0.10% maximum because of its austenite promoting tendency as well as its deleterious influence upon corrosion resistance. It is preferred to maintain carbon at 0.06% maximum so as to further minimize its above-stated effects and to reduce the amounts of relatively costly stabilizing and ferrite forming elements required to mitigate the effects of this element.

Chromium should be included in amounts sufficient to impart good corrosion resistance to the steel and to ensure that a ferritic structure is obtained. From about 11% to 30% is generally adequate to accomplish these objectives. The lower limit is sufficient to obtain a ferritic structure for stabilized stainless steels and the upper limit is of a commercially based nature in that chromium contents significantly above about 30% are not considered to be of commercial interest.

Molybdenum is optionally present in amounts up to about 3% for purposes of corrosion resistance improvement. Generally, amounts of from 0.5 to 2.0% are preferred because of cost considerations.

Columbium should be present in amounts ranging from about 0.1% to about no more than 0.3% in solid solution. However, the minimum columbium content must be further constrained when the formula, 7.7 × %C – % Zr in excess of 6.5 × N%, yields a value less than 0.1%.

The reason for such further constraint is related to the relative propensities of columbium and zirconium for combining with carbon and nitrogen. Listed in order of most favorable propensity for formation, the following carbides and nitrides may be formed by columbium and zirconium: zirconium nitride, zirconium carbide, columbium carbide and columbium nitride. The latter compound is formed much more weakly than the first three named compounds. In addition, zirconium nitride formation is relatively much more probable than zirconium and columbium carbide. The zirconium and columbium carbide formation propensities are somewhat similar.

In view of the above discussion, it is apparent that zirconium, if a sufficient amount is present, will combine with virtually all of the residual nitrogen in solution and to promote ductility in the resultant produce. However, amounts substantially in excess of that required to combine with nitrogen lead to certain adverse effects to be discussed later. Thus, the relatively restricted zirconium content of the invention enables columbium to function to combine with a large portion of the carbon with resultant stabilization by one or both elements. Because zirconium carbides are somewhat more stable than columbium carbides, the amount of zirconium in excess of that required to combine with nitrogen is free to combine with carbon. Thus, the minimum columbium content is dependent upon the amount of zirconium and nitrogen in the alloy system. For example, a composition containing 0.10% C, 0.03% N, and 0.03% Zr, would require a minimum columbium content of approximately 0.57% to ensure a stabilized alloy. On the other hand, a composition containing 0.03% C, 0.03% N and 0.40% Zr, would require a columbium content of approximately 0.02%. Such columbium content is, of course, below the specified minimum of 0.1% and the value calculated from the relationship would not apply to the composition of the invention.

The reason for specifying an absolute minimum columbium content of 0.1% is related to considerations involving the commercial refining of the alloy. As discussed below, the maximum amount of zirconium present above that required to combine with carbon and nitrogen is only 0.25%. With zirconium in excess of this amount, the ductility and corrosion resistance markedly deteriorate. As zirconium recoveries during steelmaking are quite variable, the 0.25% range would be difficult to consistently achieve in practice. By specifying a minimum columbium content of 0.1%, the zirconium content range is, in effect, increased by 0.1 to 0.35% because a lower zirconium content can now be tolerated due to the presence of columbium. The broader zirconium range is quite important to successful steelmaking due to its aforementioned variable recovery.

The upper columbium limit is no more than about 0.3% in solid solution because amounts of columbium greater than this value lead to poor weld bend test ductility. FIG. 1 illustrates the number of successful bend tests per a series of 6 tests for a zirconium-free nominal 18% Cr and 2% ferritic-alloy strips of 0.1 inch thickness. The TIG welded samples were bent 90° over a 7/16 inch radius following annealing at 1600° F for ½ hour and water quenching. Although FIG. 1 pertains to zirconium-free material, it is apparent once zirconium and columbium have combined to tie-up all of the carbon and nitrogen, excess columbium is a potential source of brittleness. Thus, the amount of columbium in solid solution should not exceed about 0.3%. Brittleness is believed to be due to the formation of adverse amounts the brittle intermetallic compound, $Cb_2(Fe, Cr)_3$.

As may be apparent from the discussion of columbium content, zirconium should be included in an amount sufficient to combine with all nitrogen in solution to provide improved product ductility (as measured by weld bend testing). The necessary minimum amount is 6.5 × %N.

The Table illustrates beneficial influence of zirconium upon TIG welded 0.1 inch thick ferritic stainless steel strips having a nominal composition of 19% Cr and about 1.5 to 2.0% Mo. The strips were produced by vacuum melting, casting into slab ingots, hot rolling to 0.20 inch thickness at 2200° F with a finishing temperature of 1600° F, annealing at 1600° F for ½ hour and air cooling, and then cold rolling to a final thickness of 0.10 inch. The strip samples were bent 90° over a 1T (0.10 inch) radius following annealing at 1600° F for ½ hour and water quenching. The criteria for passing the test was no cracks being apparent after examination with dye penetrant. As may be seen from the test results, ductility is substantially enhanced by zirconium additions in excess of 6.5 × %N. It is also apparent that amounts somewhat less than 6.5 × %N lead to improved ductility. However, 6.5 × %N has been selected as a lower limit for zirconium because such minimum amount ensures that all harmful nitrogen is removed from solution and further ensures that an effective amount of zirconium will be incorporated into the alloy during the refining process in the event that the expected per cent of recovery or yield is not attained during the zirconium addition stage.

TABLE

| %Cr | %Mo | %C | %N | %Cb | %Zr | 6.5 × %N | Weld Bend Test (Number Passed of 6) |
|---|---|---|---|---|---|---|---|
| 17.9 | 1.92 | .014 | .023 | .28 | — | — | 0 |
| 17.9 | 1.94 | .013 | .022 | .38 | — | — | 1 |
| 18.0 | 1.94 | .013 | .022 | .43 | — | — | 0 |
| 18.1 | 1.90 | .014 | .021 | .46 | — | — | 0 |
| 18.1 | 1.93 | .014 | .021 | .51 | — | — | 0 |
| 18.0 | 1.94 | .012 | .021 | .54 | — | — | 1 |
| 18.8 | 1.50 | .017 | .017 | nil | .15 | .11 | 6 |
| 18.7 | 1.51 | .017 | .017 | .12 | .10 | .11 | 6 |
| 18.5 | 1.54 | .017 | .017 | .25 | .05 | .11 | 6 |
| 18.9 | 1.52 | .018 | .018 | .30 | .13 | .12 | 5 |
| 18.9 | 1.54 | .018 | .018 | .40 | .10 | .12 | 5 |
| 18.9 | 1.50 | .018 | .018 | .54 | .05 | .12 | 5 |

Excessive amounts of zirconium in solution have a detrimental effect upon ductility due to the formation of a brittle intermetallic compound believed to be $Zr(Fe, Cr)_2$. Moreover, the excessive zirconium can lead to surface streaking when the alloy is produced in wrought form. It has been discovered that the amount of zirconium in solution should not exceed about 0.25%. Therefore, the upper limit for zirconium is no more than 0.25% above the amount of zirconium combined with carbon and nitrogen. The amount of zirconium combined with carbon and nitrogen is readily determinable because zirconium carbides and nitrides form in preference to columbium carbides and nitrides and is 6.5 × %N + 7.6 × %C.

Figure 2:
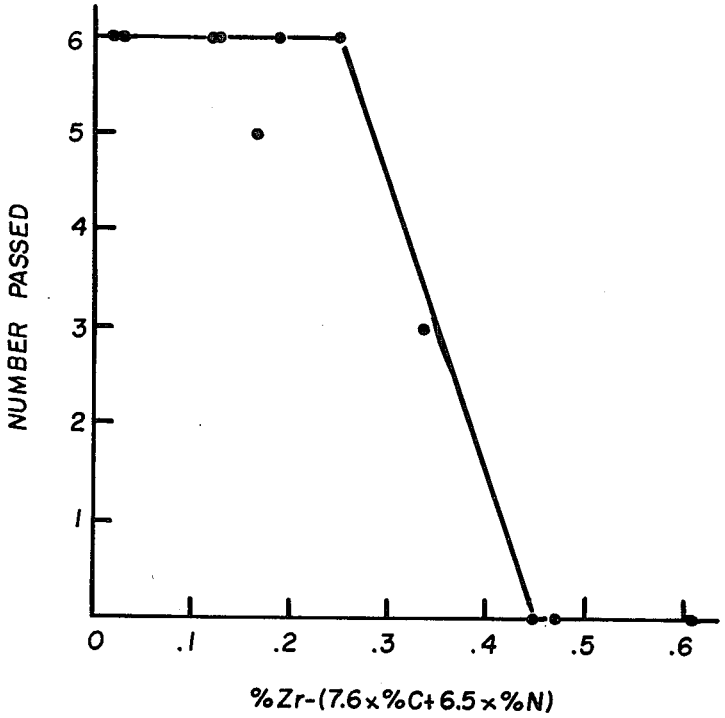
Figure 3:
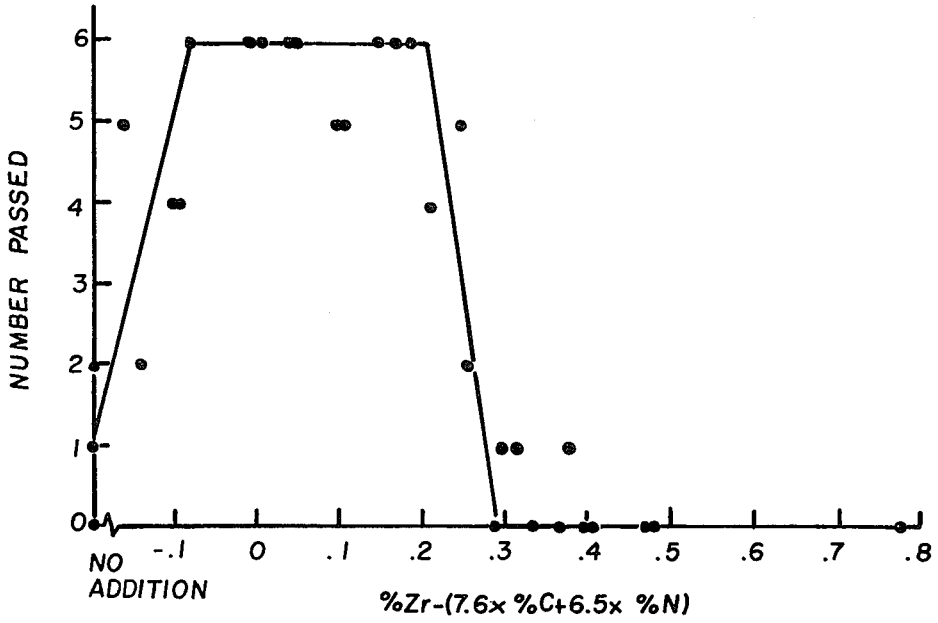

The influence of soluble zirconium upon weld ductility is graphically illustrated in FIGS. 2 and 3. As may be clearly seen, amounts of zirconium in excess of about 0.25% of 7.6 × %C - 6.5 %N result in a significant loss of ductility as depicted by weld bend testing. FIG. 2 relates to ferritic stainless steel having columbium-free compositions containing about 26% Cr and about 1% Mo. The samples represent 0.10 inch thick TIG welded strips that were annealed at 1600° F for ½ hour, water quenched prior to being bent 90° over a 1T radius. Six samples were bent for each data point and the number of the six samples that did not crack is shown on the vertical axis of the graph. The above-described test, although not of a standard nature, is useful in measuring ductility of stainless material and its results are considered to be a meaningful index of ductility in the as-welded condition which is also considered to be analogous to the as-cast condition. FIG. 3 represents a plot of data points for a ferritic stainless steel having columbium-free, 18% Cr, 2% Mo composition. The data points were obtained by following the identical procedure outlined for FIG. 1. Hence, ductility improvement or lack thereof by zirconium additions is believed to exist in both as-cast and wrought products.

Nitrogen is not normally intentionally added to the ferritic steels of the invention because nitrogen is an austenite promoting element and has an adverse effect upon ductility. However, commonly employed stainless steel refining techniques such as the electric furnace and various submerged blowing processes inherently incur nitrogen in residual quantities of from about 0.01 to 0.06%. However, quantities in excess of the above-stated range could be compensated for by zirconium additions consistent with those previously taught.

The alloy of the invention may contain the usual amount of commercially tolerable impurity elements; for example: manganese, 1.0% maximum; nickel, 1.0% maximum; sulfur, .030% maximum; phosphorus, 0.06% maximum; and silicon, 1.0% maximum.

I claim:

1. A stabilized fully ferritic stainless steel in the wrought condition having good ductility, and characterized by a minimal amount of surface streaking, consisting essentially of:

Carbon, 0.10% maximum;
Chromium, from 11% to 30%;
Molybdenum, up to 3.0%;
Nitrogen, residual quantities:
Columbium, from about 0.1% total to 0.3% in solid solution, and in no event less than (7.7 × % carbon - % zirconium in excess of 6.5 × % nitrogen);
Zirconium, from 6.5 × % nitrogen to 0.25% in excess of (6.5 × % nitrogen × 7.6% carbon); and
balance iron and residual impurities.

2. A stabilized fully ferritic stainless steel having good ductility according to claim 1, wherein said molybdenum is from 0.5 to 2.0%.

3. A stabilized fully ferritic stainless steel having good ductility according to claim 1, wherein said carbon is 0.05% maximum.

* * * * *